US009448531B2

(12) United States Patent
Hanano

(10) Patent No.: US 9,448,531 B2
(45) Date of Patent: Sep. 20, 2016

(54) IMAGE FORMING APPARATUS

(71) Applicant: KYOCERA Document Solutions, Inc., Osaka (JP)

(72) Inventor: Susumu Hanano, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/905,148

(22) PCT Filed: Jul. 6, 2015

(86) PCT No.: PCT/JP2015/069384
§ 371 (c)(1),
(2) Date: Jan. 14, 2016

(87) PCT Pub. No.: WO2016/009867
PCT Pub. Date: Jan. 21, 2016

(65) Prior Publication Data

US 2016/0223975 A1 Aug. 4, 2016

(30) Foreign Application Priority Data

Jul. 15, 2014 (JP) ..... 2014-145133

(51) Int. Cl.
*G03G 21/16* (2006.01)
*G03G 21/18* (2006.01)
*G03G 15/00* (2006.01)

(52) U.S. Cl.
CPC ..... *G03G 21/185* (2013.01); *G03G 15/75* (2013.01); *G03G 2221/1654* (2013.01)

(58) Field of Classification Search
CPC ..... G03G 15/75; G03G 15/751; G03G 21/1842; G03G 21/185; G03G 21/1647; G03G 2221/1654
See application file for complete search history.

(56) References Cited

U.S. PATENT DOCUMENTS 7,663,658 B2 2/2010 Murano et al.
9,348,305 B2 * 5/2016 Kanai ..... G03G 21/1842

(Continued)

FOREIGN PATENT DOCUMENTS

JP 2007041494 A 2/2007
JP 2007183426 A 7/2007

(Continued)

OTHER PUBLICATIONS

International Search Report issued in corresponding PCT/JP2015/069384, mailed Aug. 11, 2015.

*Primary Examiner* — David Gray
*Assistant Examiner* — Carla Therrien
(74) *Attorney, Agent, or Firm* — Studebaker & Brackett PC

(57) ABSTRACT

An image forming apparatus (1) includes an image carrier unit (15) and a positioning member (30) configured to position the image carrier unit (15) to the apparatus main body (2). The image carrier unit (15) has a concentric circumference part (51L), (51R) formed on a concentric circle with a rotating shaft (9*a*) of the image carrier (9) and the apparatus main body (2) has an edge part (42L), (42R) facing the concentric circumference part (51L), (51R) at the attachment position. The positioning member (30) has an intervening part (37) formed with an edge side abutment face (37*a*) facing the edge part (42L), (42R) of the apparatus main body (2) and a unit side abutment face (37*b*) facing the concentric circumference part (51L), (51R) of the image carrier unit (15).

9 Claims, 10 Drawing Sheets

(56) References Cited

U.S. PATENT DOCUMENTS

2006/0239712 A1* 10/2006 Yamaguchi ..... G03G 21/185 399/111
2007/0160383 A1 7/2007 Matsumoto et al.
2008/0138106 A1* 6/2008 Kanno ..... G03G 21/185 399/111
2008/0138110 A1* 6/2008 Yoshino ..... G03G 21/1832 399/114
2009/0116869 A1 5/2009 Kotsuka et al.
2011/0299882 A1* 12/2011 Tanaami ..... G03G 15/326 399/110

FOREIGN PATENT DOCUMENTS

JP 2009116315 A 5/2009
JP 2013250346 A 12/2013

* cited by examiner

IMAGE FORMING APPARATUS

TECHNICAL FIELD

The present invention relates to an image forming apparatus provided with a drum unit which supports an image carrier such as a photosensitive drum.

BACKGROUND

An image forming apparatus, such as a copying machine, a printer or a multifunction peripheral, is sometimes constructed such that an image carrier on which an electrostatic latent image is formed, such as a photosensitive drum, a charging device, a cleaning device or the like are integrated into a unit and this unit is attachably/detachably supported to an apparatus main body by sliding operation. In an image forming apparatus for full color, since the units for every color are provided, in order to prevent color displacement, each of the units needs to be positioned with respect to the apparatus main body with a high precision.

In order to position each of the units with respect to the apparatus main body, there may be a case in which a retainer made of a metal plate is used. The retainer is a positioning member having a bearing hole into which a front end of a rotating shaft of the image carrier of each unit is to be inserted. In such each unit, a rear end of the rotating shaft of the image carrier is inserted into a shaft supporting hole formed in the apparatus main body and the front end of the rotating shaft is held in the bearing hole of the retainer. Then, by positioning the retainer with respect to the apparatus main body, it makes possible to improve a precision of a relative position of each image carrier.

As a construction to position each unit by employing the retainer, in Patent Literature 1, there is proposed an image forming apparatus configured such that a front end of a rotating shaft of an image carrier is held in a shaft supporting hole formed in the retainer by self-weight. This image forming apparatus is further provided with a pressing member to press and position the rotating shaft held in the shaft supporting hole and a sliding member to slide the pressing member between a pressing position where the pressing member presses the rotating shaft and a non-pressing position where the pressing member comes into non-contact with the rotating shaft.

PRIOR ART DOCUMENT

Patent Document

[Patent Document 1] Japanese Patent laid-open Publication No. 2007-41494

SUMMARY OF INVENTION

Problems to be Solved by the Invention

However, in the image forming apparatus shown in the Patent Literature 1, when each unit is attached to the apparatus main body, it is necessary to slide each unit to an attachment position with respect to the apparatus main body, subsequently attach the retainer so as to support the rotating shafts of the image carriers in the respective bearing holes, and further slide the sliding members to the pressing position to position the rotating shafts.

Also, while the apparatus main body and the retainer are formed of the metal plate as described previously, the units are generally made of resin; and therefore, the units may be damaged because the apparatus main body or the retainer comes into contact with the units at the time of sliding of the units or at the time of attaching the retainer.

In the construction in which the retainer is used, there are problems that the construction becomes complicated, resulting in higher costs, and the work of attaching and detaching the units is complicated or difficult, resulting in poor workability, and further, the units are easily damaged.

The present invention has been made in view of the circumstance described above, and it is an object of the present invention to provide an image forming apparatus capable of positioning an image carrier unit with respect to an apparatus main body with a simple construction.

Means of Solving the Problems

An image forming apparatus according to the present invention includes: an image carrier unit configured to rotatably support an image carrier on which an electrostatic latent image is to be formed and attachable to or detachable from an apparatus main body; and a positioning member configured to position the image carrier unit with respect to the apparatus main body at an attachment position, wherein the image carrier unit has a concentric circumference part formed on a concentric circle with a rotating shaft of the image carrier, the apparatus main body has an edge part facing the concentric circumference part at the attachment position, the positioning member has an intervening part formed with an edge side abutment face facing the edge part of the apparatus main body and a unit side abutment face facing the concentric circumference part of the image carrier unit, and wherein the intervening part is intervened between the concentric circumference part of the image carrier unit and the edge part of the apparatus main body so that the image carrier unit is positioned with respect to the apparatus main body.

Effects of the Invention

By employing such a construction, since the image carrier unit can be positioned with respect to the apparatus main body only by attaching the positioning member to the apparatus main body, the work of attaching and detaching the image carrier unit can be easily carried out. Further, in a full color image forming apparatus, since the image carrier units for each color of toner are positioned in an apparatus main body by employing the positioning members with a same construction, a relative position precision between the image carrier units is enhanced and thus a color displacement can be reliably prevented. Also, since the concentric circumference parts formed on the concentric circle with the rotating shaft of the image carrier is employed for positioning of the image carrier unit with respect to the apparatus main body, a positioning precision of the image carrier itself can be enhanced.

THE MODE FOR CARRYING OUT THE INVENTION

Hereinafter, with reference to figures, an image forming apparatus according to an embodiment of the present disclosure will be described.

Figure 1:
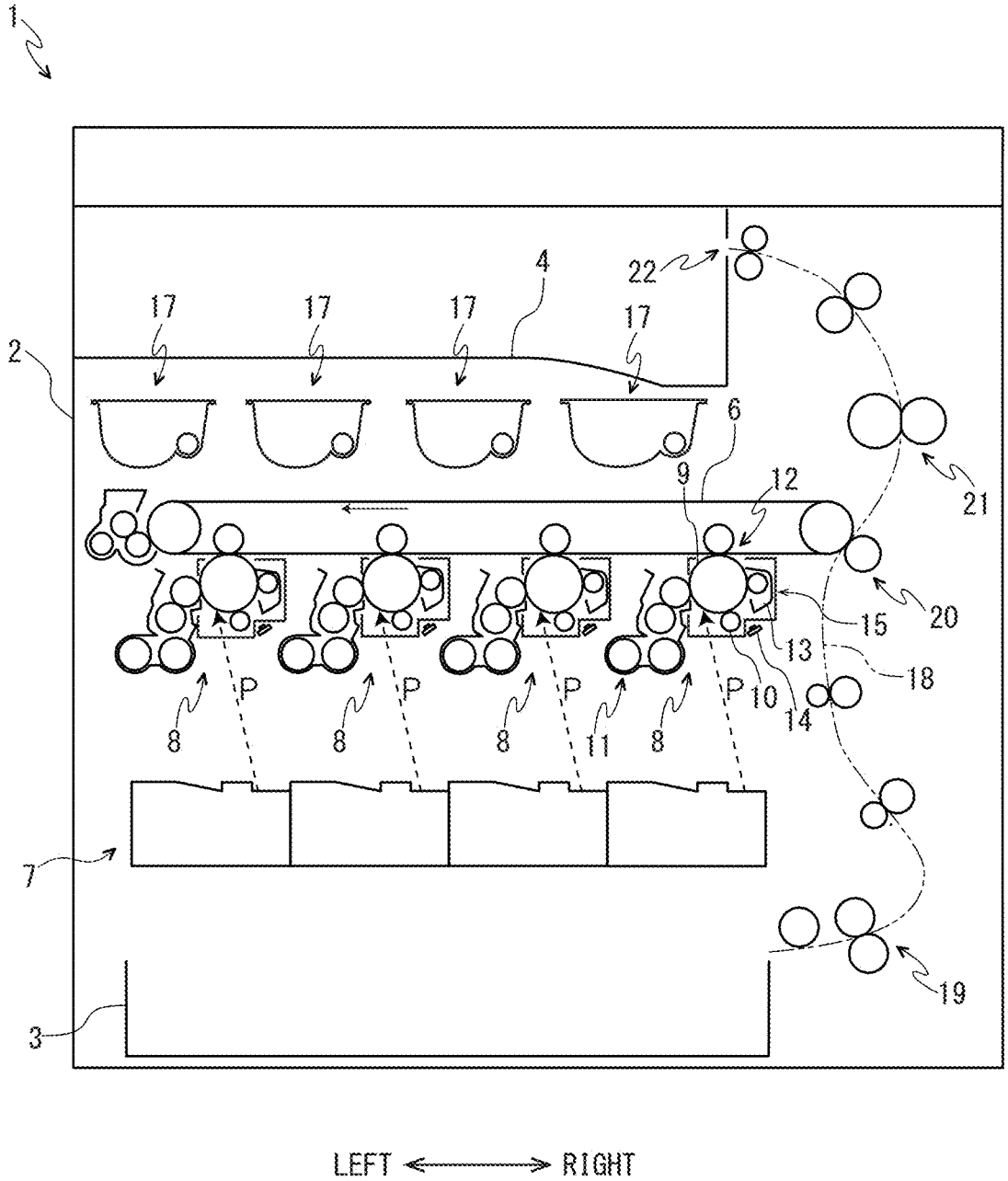
FIG. 1 is a schematic view showing an outline of a construction of a color printer according to an embodiment of the present invention.

First, with reference to FIG. 1, an entire structure of a color printer 1 (image forming apparatus) will be described. FIG. 1 is a schematic diagram schematically showing the color printer according to an embodiment of the present disclosure. In the following description, a front side of the sheet plane of FIG. 1 shows a front side of the color printer 1 and left and right directions are based on a direction viewed from the front side of the color printer 1.

The color printer 1 is provided with a box-like shaped printer main body 2. In a lower part of the printer main body 2, a sheet feeding cassette 3 storing a sheet (not shown) and on an upper face of the printer main body 2, an ejected sheet tray 4 is provided.

In a center part of the printer main body 2, an intermediate transferring belt 6 is bridged between a plurality of rollers, and under the intermediate transferring belt 6, an exposure device 7 containing a laser scanning unit (LSU) is arranged. Along the lower face of the intermediate transferring belt 6, four image forming parts 8 for each color (for example, magenta, cyan, yellow and black) of toner are provided side by side in the left and right directions. In each image forming part 8, a photosensitive drum 9 (image carrier) is rotatably provided. Around the photosensitive drum 9, a charger 10, a development unit 11, a first transferring part 12, a cleaning device 13 and a static eliminator 14 are arranged in the order of the first transferring process. The photosensitive drum 9, the charger 10 and the cleaning device 13 are integrated into a drum unit (image carrier unit) 15. Above the development units 11, toner containers 7 for respective image forming parts 8 are provided for each color of the toner.

Along one side (the right side in the figure) of the printer main body 2, a sheet conveying path 18 is formed extending from the sheet feeding cassette 3 to the sheet ejecting tray 4. At the upstream end of the sheet conveying path 18, a sheet feeding part 19 is provided, at the midstream portion of the sheet conveying path 18, a second transferring part 20 is provided on one end (the right end in the figure) of the intermediate transferring belt 6, at the downstream portion of the sheet conveying path 18, a fixing device 21 is provided, and at the downstream end of the sheet conveying path 18, a sheet ejecting port 22 is provided.

Next, the operation of forming an image by the color printer 1 having such a configuration will be described. When image data is inputted from a computer or the like connected to the color printer 1, the image forming operation is carried out as follows.

After the surface of the photosensitive drum 9 is charged by the charger 10, the exposure device 7 exposes the surface of the photosensitive drum 9 with a laser light (refer to an arrow P) to form an electrostatic latent image on the surface of the photosensitive drum 9. The electrostatic latent image is then developed into a toner image of corresponding color by the developing unit 11. The toner image is first-transferred on the intermediate transferring belt 6 at the first transferring part 12. The above-mentioned operation is repeated in order by the image forming parts 9, thereby forming a full color toner image onto the intermediate transferring belt 6. Incidentally, toner and residual electric charge remained on the photosensitive drum 9 is removed by the cleaning device 13 and the static eliminator 14, respectively.

On the other hand, the sheet fed from the sheet feeding cassette 3 by the sheet feeding part 19 or a bypass tray (not shown) is conveyed to the second transferring part 20 in a suitable timing for the above-mentioned image forming operation. Then, in the second transferring part 20, the full color toner image on the intermediate transferring belt 6 is second-transferred onto the sheet. The sheet with the second-transferred toner image is conveyed to the downstream side along the sheet conveying path 18 to enter the fixing device 21, and then, the toner image is fixed on the sheet in the fixing device 21. The transfer sheet with the fixed toner image is ejected through the sheet ejecting port 22 to the ejected sheet tray 4.

Figure 2:
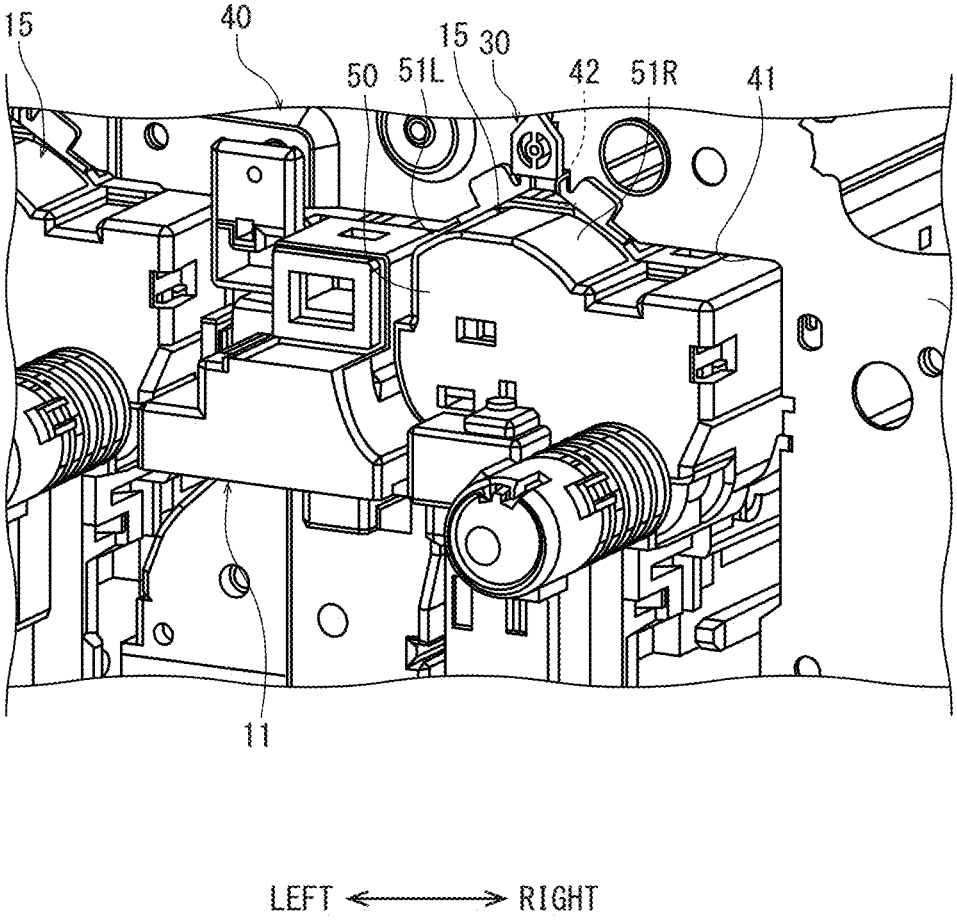
FIG. 2 is a perspective view showing a front end part of a drum unit viewed from a front side, in the color printer according to the embodiment of the present invention.
Figure 3:
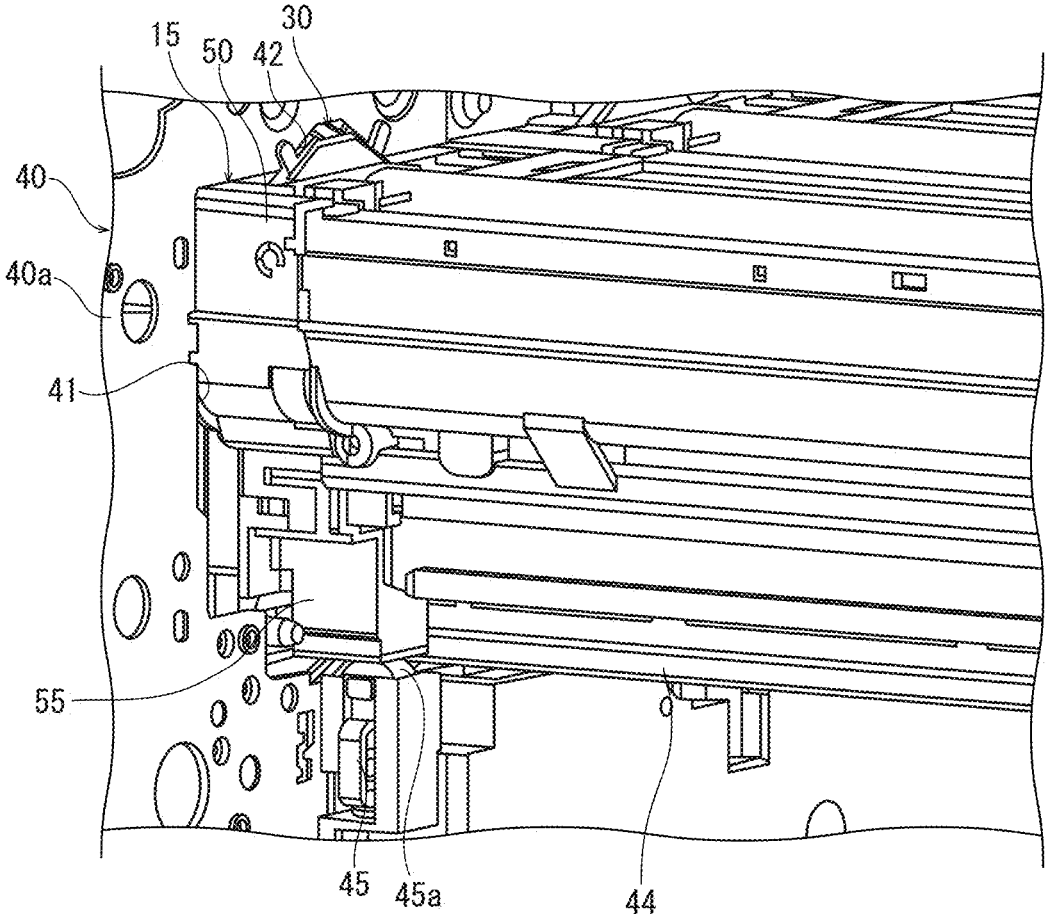
FIG. 3 is a perspective view showing the front end part of the drum unit viewed from a right side, in the color printer according to the embodiment of the present invention.
Figure 4:
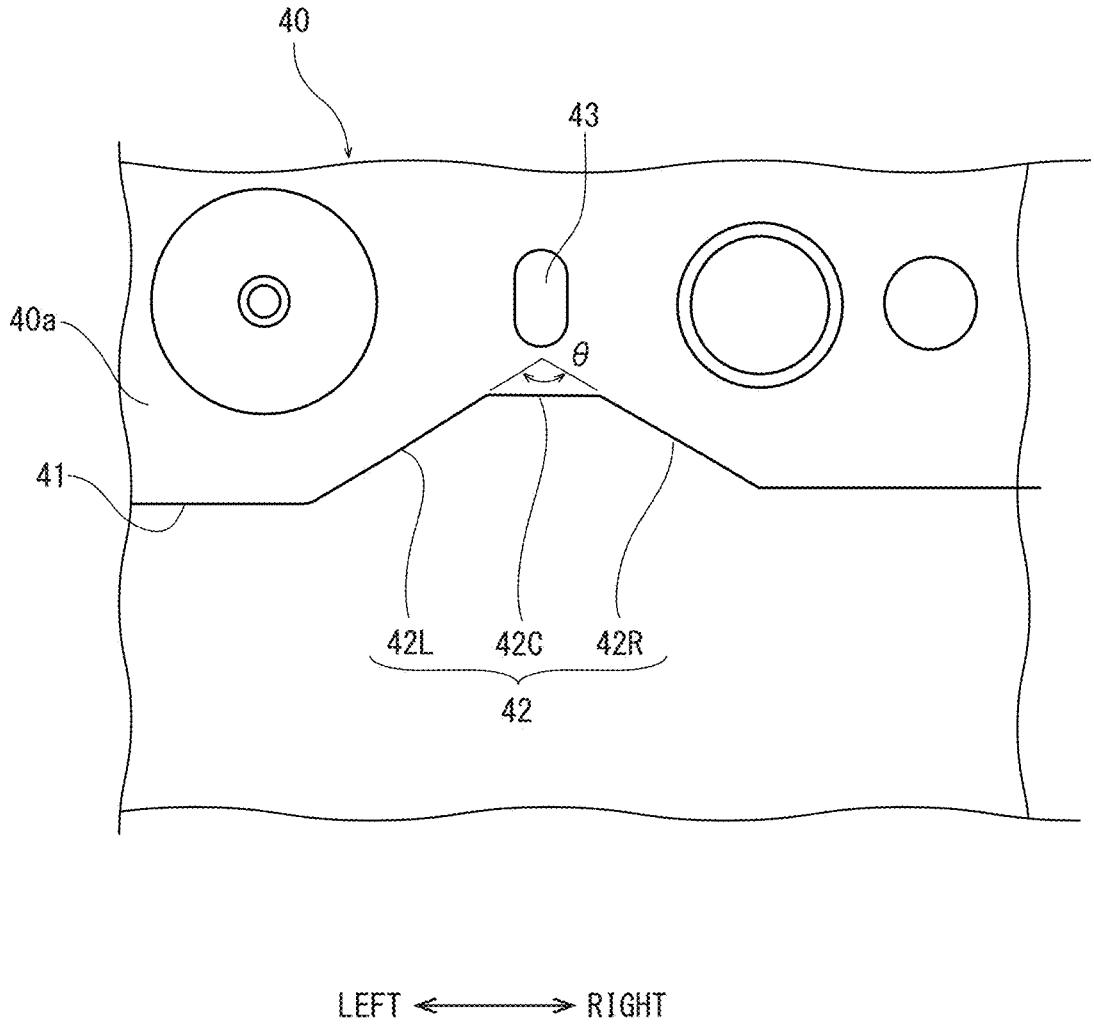
FIG. 4 is a front view showing a drum unit attachment opening of a printer main body, in the color printer according to the embodiment of the present invention.
Figure 5:
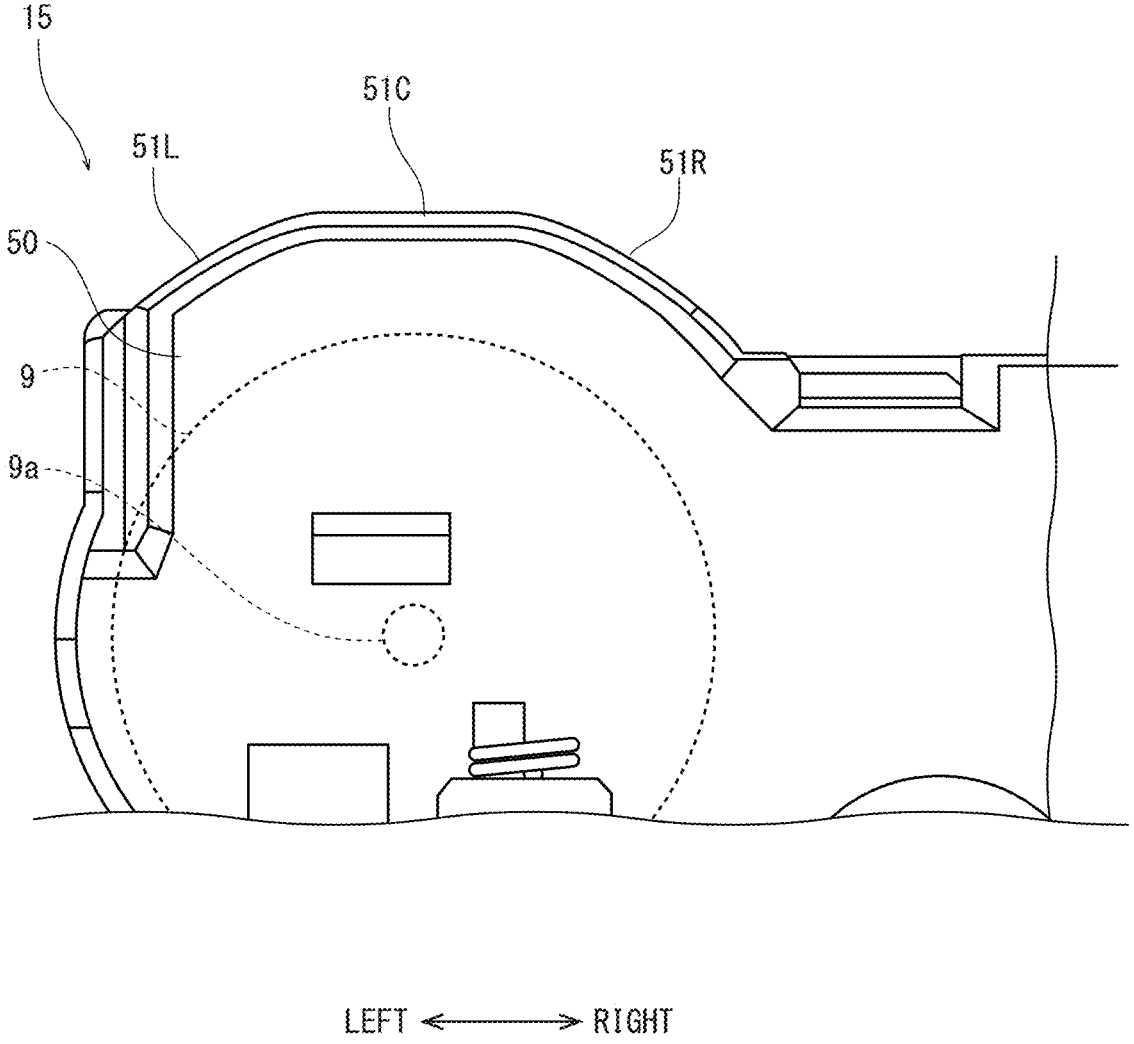
FIG. 5 is a front view showing the drum unit, in the color printer according to the embodiment of the present invention.

Next, the drum unit 15 will be described with reference to FIG. 2 to FIG. 5. FIG. 2 is a perspective view showing the front end part of the drum unit attached to the printer main body, viewed from the front side; FIG. 3 is a perspective view showing the front end part of the drum unit attached to the printer main body, viewed from the right side; FIG. 4 is a front view showing the drum unit attachment opening of the printer main body; and FIG. 5 is a front view showing the drum unit.

The drum unit 15 is configured to be attachable to or detachable from the printer main body 2 by the sliding operation in an axial direction of a rotating shaft 9*a* of a photosensitive drum 9 and is positioned at an attachment position by a positioning member 30.

A framework of the printer main body 2 is constructed by a casing 40 made of a metal plate. The casing 40 is formed in a box shape, and as shown in FIG. 2 and FIG. 3, has a front side plate 40*a* and a rear side plate (not shown) which oppose to each other in the front and rear directions. The rear side plate is formed with a bearing hole to which the rotating shaft 9*a* of the photosensitive drum 9 is inserted, at positions corresponding to respective photosensitive drums 9 of the drum units 15. Also, the front side plate 40*a* is formed with an elongated substantially rectangular opening 41 into which the drum units 15 or the development units 11 are to be inserted. The opening 41 is divided into an attachment section to which corresponding drum unit 15 is to be attached.

In each of the attachment sections of the opening 41, as shown in FIG. 4, a flat trapezoidal notch 42 in a front view is formed along the upper edge. The notch 42 is formed symmetrically in the left and eight directions in a front view, and has a horizontal center edge 42C, and a left edge 42L and a right edge 42R extending in a truncated reverse V-shape toward a left lower direction and a right lower direction from the left end and right end of the center edge 42C, respectively. The left and right edges 42L, 42R extend in the reverse V-shape at a center angle θ. Above the center edge 42C, a vertically long elongated hole 43 is formed.

In each of the attachment sections, as shown in FIG. 3, a pair of left and right rails 44 are bridged between the front and rear side plates under the opening 41. The rails 44 are inclined slightly upward toward the rear direction. Also, on an inside face of the front side plate 40*a*, a drum unit biasing mechanism 45 is provided under the opening 41. The drum unit biasing mechanism 45 has a roller-shaped pressing member 45*a* and a coil spring to bias the pressing member 45*a* upward, and is configured to bias the drum unit 15 upward.

The drum unit 15, as shown in FIG. 5, has a box-shaped casing 50 made of resin. Inside of the casing 50, the photosensitive drum 9 is housed rotatably around the rotating shaft 9*a*, and the charger 10 and the cleaning device 13 are housed at appropriate positions along the periphery of the photosensitive drum 9. The rear end of the rotating shaft 9*a* of the photosensitive drum 9 protrudes rearward from the casing 50.

The casing 50 is formed with left and right concentric circumferences parts 51L, 51R formed on a concentric circle with the rotating shaft 9*a* of the photosensitive drum 9 on the left and right sides of a horizontal flat plate part 51C, respectively, on a part of the front end of the upper face. The left and right concentric circumferences parts 51L, 51R each have a same center angle (the center angle around the rotating shaft 9*a* of the photosensitive drum 9) and are formed symmetrically in the left and right directions.

Further, on the lower face of the casing 50, a sliding part (not shown) engaging with the rail 44 of the casing 40 is provided extending in the front and rear directions. Furthermore, as shown in FIG. 3, on the front end of the lower face of the casing 50, a protrusion 55 protruding downward is formed. A lower face of the protrusion 55 is formed to be flat.

Figure 6A:
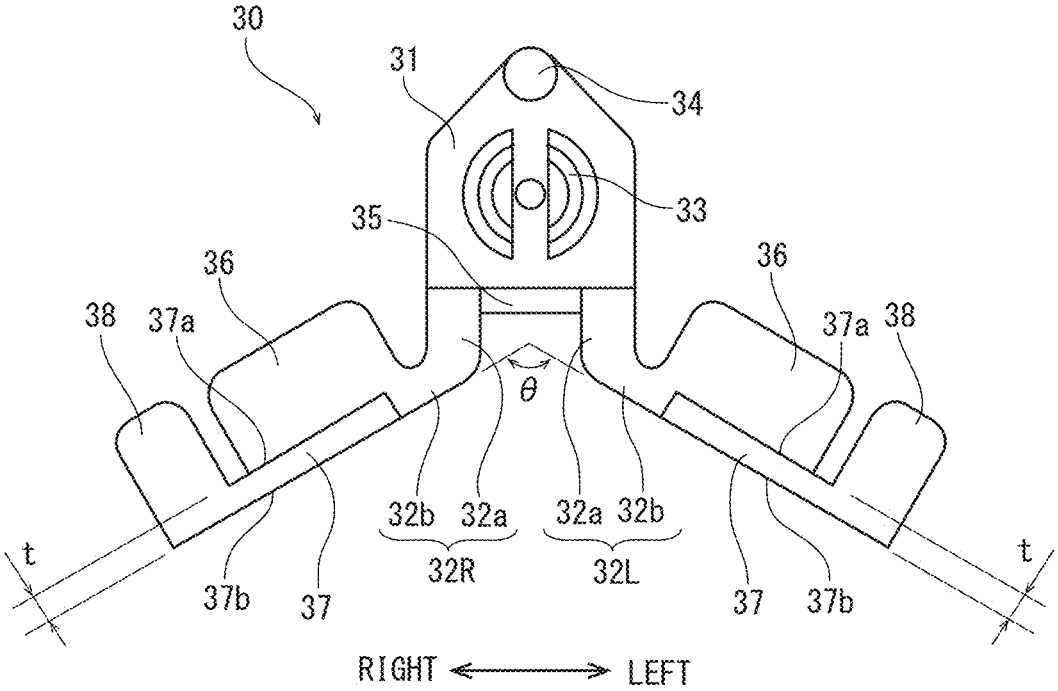
FIG. 6A is a rear view showing a positioning member, in the color printer according to the embodiment of the present invention.
Figure 6B:
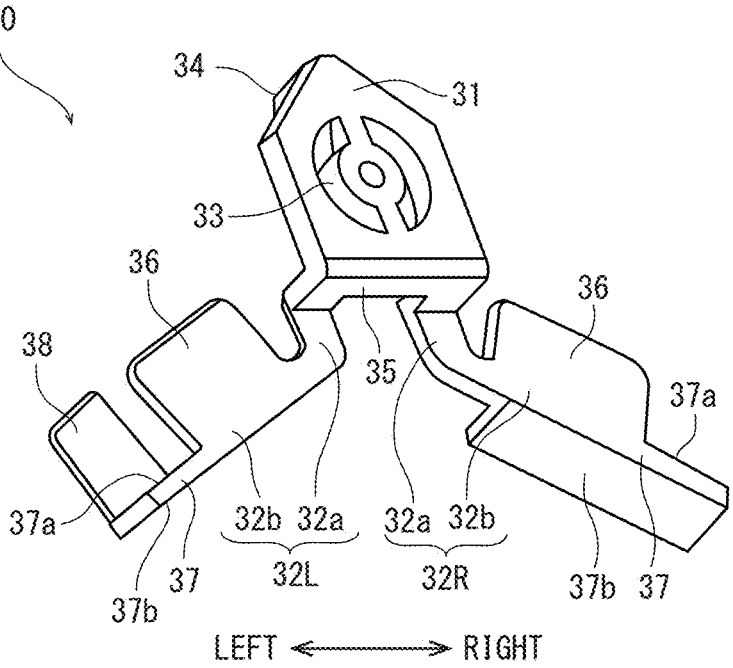
FIG. 6B is a perspective view showing the positioning member, in the color printer according to the embodiment of the present invention.

The positioning member 30 will be described with reference to FIG. 6A, FIG. 6B or the like. FIG. 6A is a rear view of the positioning member and FIG. 6B is a perspective view of the positioning member. The positioning member 30, as shown in FIG. 2, is interposed between the notch 42 formed in the opening 41 of the front side plate 40*a* of the casing 40 and the left and right concentric circumferences parts 51L, 51R of the casing 50 of the drum unit 15. As shown in FIG. 6A and FIG. 6B, the positioning member 30 has a supporting part 31 provided at the center and arm pieces 32L, 32R extending in a truncated reverse V-shape from the lower side of the supporting part 31 and is made of resin (for example, polypropylene resin).

The supporting part 31 is formed in a hexagonal flat plate shape in a front view. On the center portion of the rear face of the supporting part 31, a supporting shaft 33 protruding rearward is formed. The supporting shaft 33 is formed of a pair of halves obtained by vertically dividing a three-stepped shaft with a gap extending in a vertical direction. Further, on the rear face of the supporting part 31, an upper shaft 34 protruding rearward is formed above the supporting shaft 33. A height of the upper shaft 34 is formed to be lower than a height of the supporting shaft 33. Furthermore, along the lower edge of the supporting part 31, a step part 35 bending rearward is formed.

The left arm piece 32L and the right arm piece 32R are provided in a truncated reverse V-shape in a front view so as to extend in the lower left direction and the lower right direction from the left end and the right end of the front edge of the step part 35, respectively. The left arm piece 32L and the right arm piece 32R have proximal parts 32*a* extending downward from the left end and the right end of the front edge of the step part 35 and main body parts 32*b* extending linearly from tip ends of the proximal parts 32*a* in an oblique left lower direction and an oblique right lower direction, respectively. In the left and right arm pieces 32L, 32R, an angle θ between the main body parts 32*b* is formed to be equal to the angle θ between the left and right edges 42L, 42R (refer to FIG. 4) in the notch 42 of the opening 41 of the casing 40. The main body part 32*b* is formed with an elongated rectangular-shaped front tongue piece 36 extending upward along a portion close to the proximal part 32*a*. Further, on the rear face of the main body part 32*b*, an intervening part 37 is formed.

The intervening part 37 is flat-plate shaped elongated along the main body 32*b* and has a flat upper face (edge side abutment face) 37*a* and a flat lower face (unit side abutment face) 37*b*. The upper face 37*a* and the lower face 37*b* are formed in parallel to each other. As an example, an interval t (a thickness of the intervening part 37) between the upper face 37*a* and the lower face 37*b* is 1 mm and a tolerance in a thickness direction of the intervening part 37 is ±0.02 mm or less. In addition, a length of the intervening part 37 in the front and rear directions is formed to be longer than a thickness of the front side plate 40*a* of the casing 40. The intervening part 37 is provided along the lower edge of the main body part 32*b* on the rear face of the main body part 32*b* of each of the left and right arm pieces 32L, 32R. In the left and right arm pieces 32L, 32R, an angle between the upper faces 37*a* of the intervening parts 37 and an angle between the lower faces 37*b* of the intervening parts 37 are equal to the angle θ between the main body parts 32*b*.

On the rear face of the intervening part 37, a rear tongue piece 38 extending upward is formed. The rear tongue piece 38 has a rectangular shape which is smaller in width than the front tongue piece 36. The front tongue piece 36 and the rear tongue piece 38 are parallel to each other and are shifted in the left and right directions in a front view. Further, the front tongue piece 36 and the rear tongue piece 38 are perpendicular to the upper and lower faces 37*a*, 37*b* of the intervening part 37.

Figure 7:
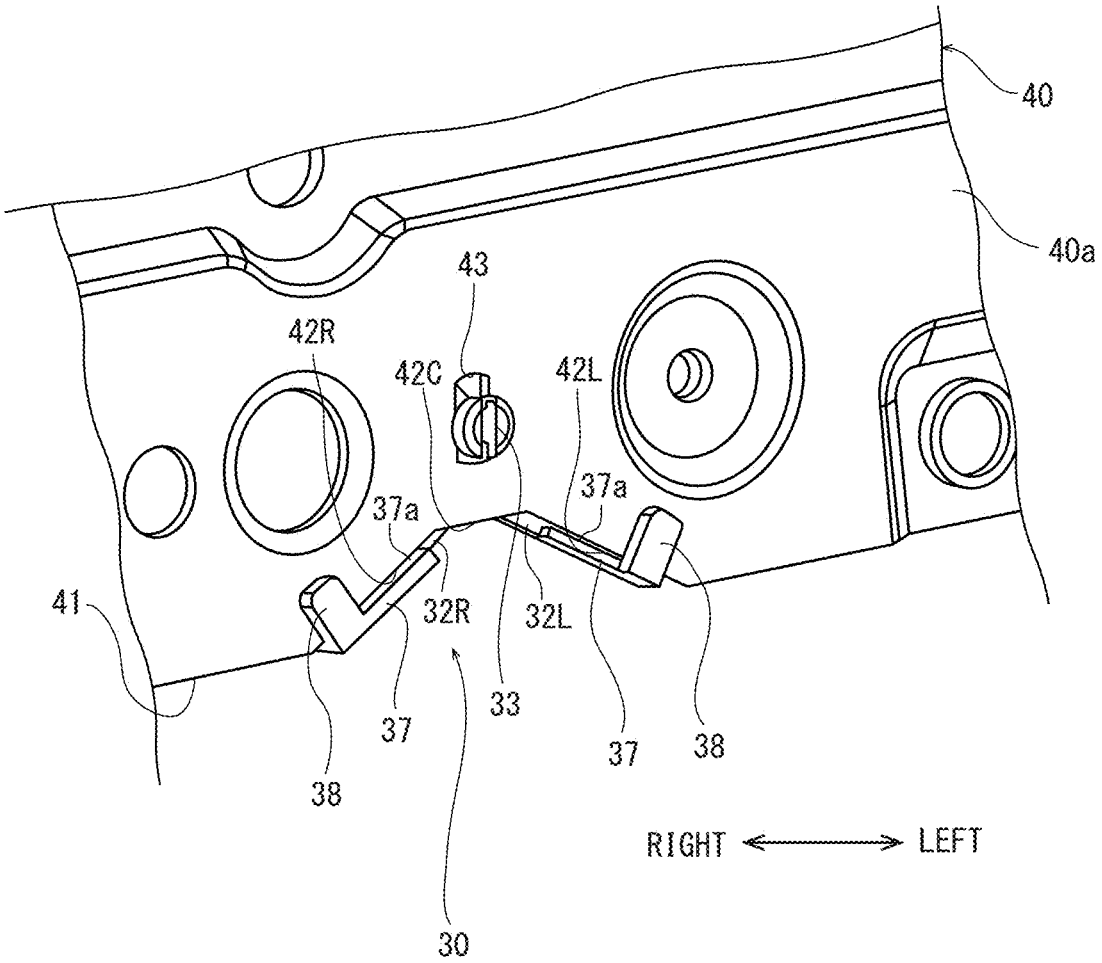
FIG. 7 is a perspective view showing the positioning member supported on the printer main body viewed from a rear side, in the color printer according to the embodiment of the present invention.
Figure 8A:
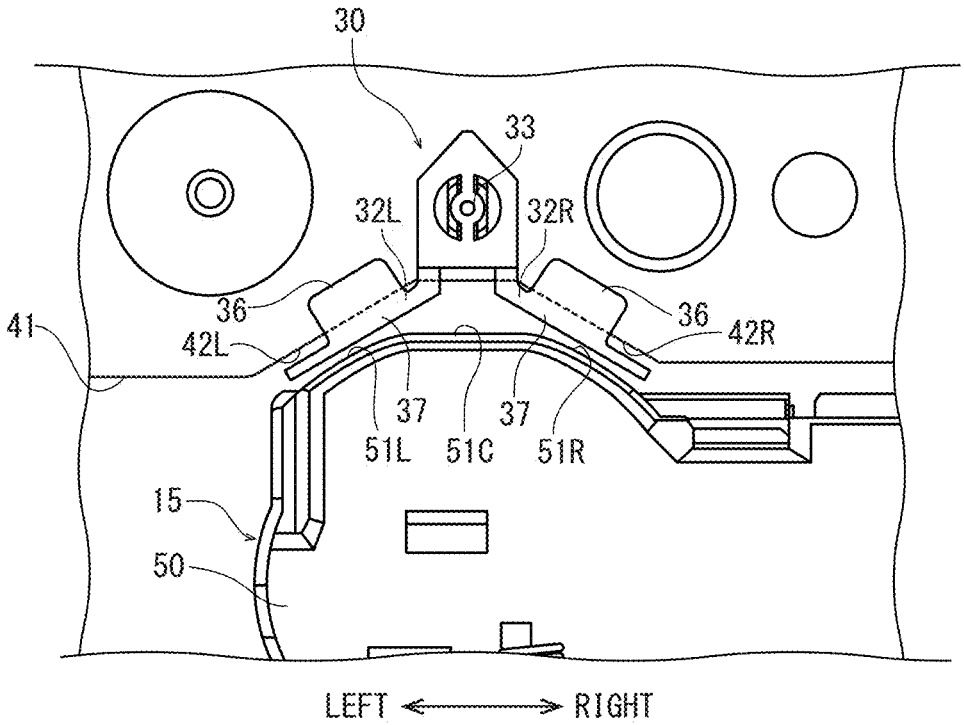
FIG. 8A is a front view showing the drum unit before biased by a drum unit biasing mechanism, in the color printer according to the embodiment of the present invention.
Figure 8B:
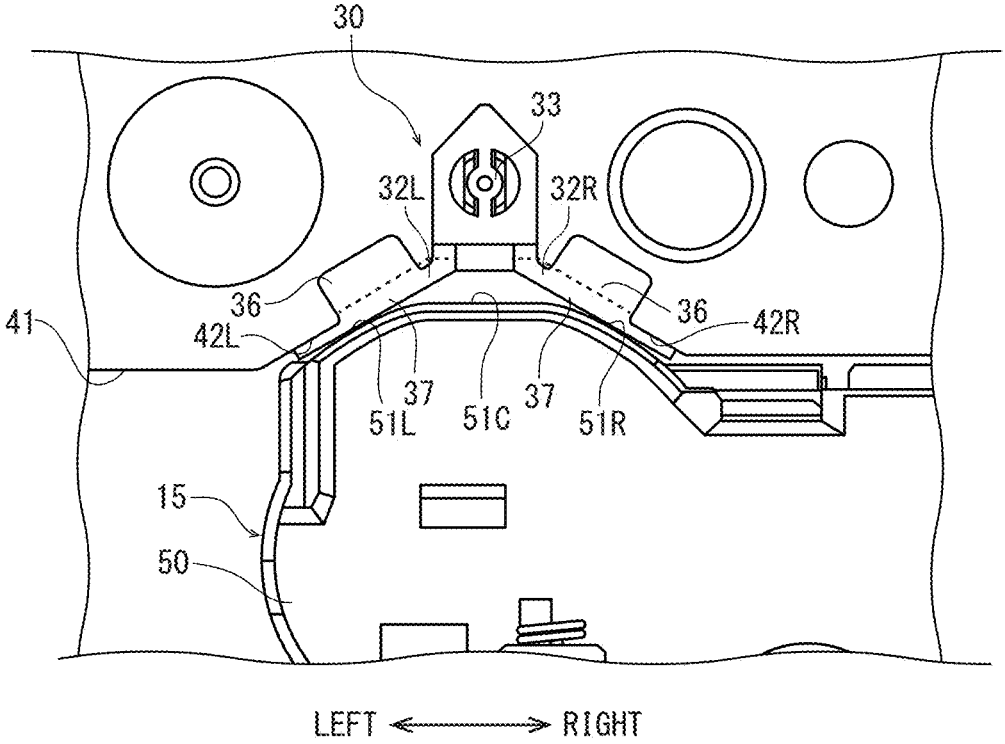
FIG. 8B is a front view showing the drum unit biased by the drum unit biasing member, in the color printer according to the embodiment of the present invention.
Figure 9:
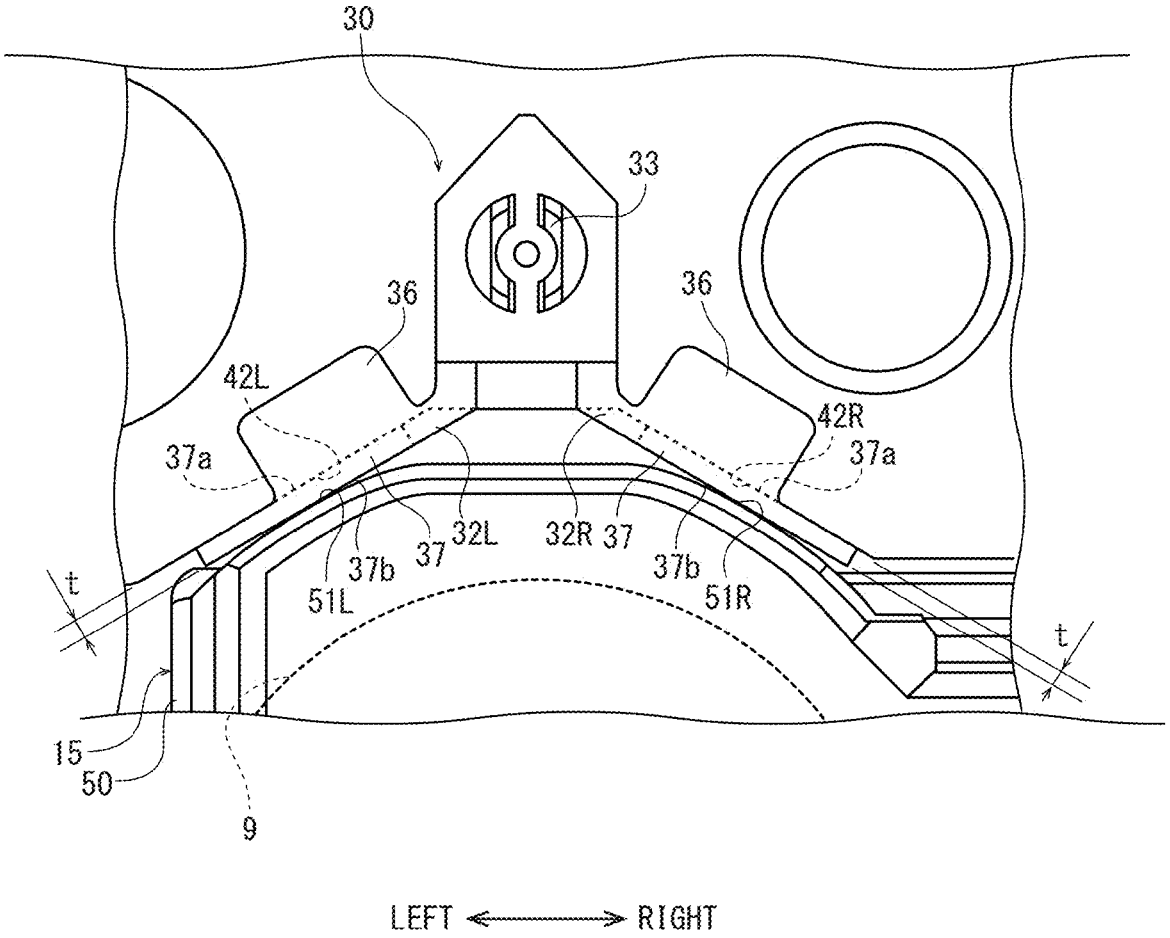
FIG. 9 is a front view showing the drum unit at an attachment position, in the color printer according to the embodiment of the present invention.

A method of attaching the drum unit 15 to the printer main body 2 by employing the positioning member 30 having the above construction will be described with reference to FIG. 7 to FIG. 9 or the like. FIG. 7 is a perspective view showing the positioning member supported to the printer main body, viewed from the rear side; FIG. 8A is a front view showing the drum unit before biased by the drum unit biasing mechanism; FIG. 8B is a front view showing the drum unit after biased by the drum unit biasing mechanism; and FIG. 9 is a front view enlarging and showing the vicinity of the positioning member at the attachment position.

When the drum unit 15 is attached to the printer main body 2, first, the positioning member 30 is caused to be supported to the casing 40 of the printer main body 2. At this juncture, as shown in FIG. 7, the supporting shaft 33 of the positioning member 30 is caused to be inserted from the front side into the elongated hole 43 formed above the opening 41 formed in the front sideplate 40*a* of the casing 40. The supporting shaft 33 can be supported to the elongated hole 43 movably in the vertical direction and swingably in the left and right directions by deforming each of the halves inward. Incidentally, at this juncture, the supporting shaft 33 is inserted into a position close to the lower end of the elongated hole 43.

In addition, when the left and right edges 42L, 42R of the notch 42 are respectively fitted between the front tongue pieces 36 and the rear tongue pieces 38 of the left and right arm pieces 32L, 32R, the upper faces 37*a* of the intervening parts 37 of the left and right arm pieces 32L, 32R respectively face the left and right edges 42L, 42R of the notch 42 at predetermined intervals. Also, the rear faces of the front tongue pieces 36 of the left and right arm pieces 32L, 32R face the front face of the front side plate 40*a* and the front faces of the rear tongue pieces 38 face the rear face of the front side plate 40*a*.

Incidentally, as described previously, the length of the intervening part 37 in the front and rear directions is formed to be longer than the thickness of the front side plate 40*a* of the casing 40. Also, the supporting shaft 33 can be moved inside the elongated hole 43 in the front and rear directions by deforming inward. This makes it possible to move the positioning member 30 in the front and rear directions between a position at which the rear faces of the front tongue pieces 36 of the left and right arm pieces 32L, 32R abut against the front face of the front side plate 40*a* and another position at which the front faces of the rear tongue pieces 38 abut against the rear face of the front side plate 40*a*.

Namely, the positioning member 30 is supported in the front sideplate 40*a* so as to be movable in the vertical direction and swingable in the left and right directions and further movable in the front and rear directions.

Next, the drum unit 15 is caused to be positioned to corresponding attachment section of the opening 41 formed in the front side plate 40*a* of the casing 40, a slider provided on the lower face of the casing 50 is caused to engage with the rail 44 (refer to FIG. 3) bridged between the front and rear side plates of the casing 40 and then is caused to slide rearward along the rail 44. When the drum unit 15 slides up to the rear end of the rail 44, the rotating shaft 9*a* of the photosensitive drum 9 protruding from the rear face of the casing 50 is inserted into the bearing hole formed in the rear side plate. Incidentally, as described previously, since the rail 44 is inclined slightly upward toward the rear side, the drum unit 15 does not interfere with the transferring belt 6 during the sliding of the drum unit 15.

When the drum unit 15 slides up to the rear end of the rail 44, as shown in FIG. 8A, the left and right concentric circumferences parts 51L, 51R provided on the front end portion of the upper face of the casing 50 are respectively positioned below the lower faces 37*b* of the intervening parts 37 of the left and right arm pieces 32L, 32R of the positioning member 30. Further, as shown in FIG. 4, the protrusion 55 provided on the lower face of the casing 50 abuts against the upper face of the pressing member 45*a* of the drum unit biasing mechanism 45 provided on the front side plate 40*a* and biases the front end of the drum unit 15 upward.

When the front end of the drum unit 15 is biased upward, as shown in FIG. 8B, the left and right concentric circumferences parts 51L, 51R of the casing 50 move upward and abut against the lower faces 37*b* of the respective intervening parts 37 of the positioning member 30. At this juncture, the supporting shaft 33 of the positioning member 30 swings in the left and right directions. This causes apexes of the left and right concentric circumferences parts 51L, 51R of the casing 50 to abut against the lower faces 37*b* of the intervening parts 37. The intervening parts 37 are pushed upward by the left and right concentric circumferences parts 51L, 51R of the casing 50. In the positioning member 30, the supporting shaft 33 moves upward inside the elongated hole 43.

Incidentally, while the positioning member 30 moves upward, since the front tongue piece 36 and the rear tongue piece 38 respectively provided at the left and right arm pieces 32L, 32R prevent the positioning member 30 from swinging in the front and rear directions, the intervening parts 37 are pushed up in a substantially parallel posture with the left and right edges 42L, 42R. The positioning member 30 moves upward until the upper faces 37*a* of the intervening parts 37 respectively abut against the left and right edges 42L, 42R of the notch 42 in the opening 41 of the front side plate 40*a*.

Afterwards, as shown in FIG. 9, the upper faces 37*a* of the intervening parts 37 of the positioning member 30 abut against the left and right edges 42L, 42R of the front side plate 40*a* and also the apexes of the left and right concentric circumferences parts 51L, 51R of the casing 50 abut against the lower faces 37*b* of the intervening parts 37. In this manner, an interval between the left and right edges 42L, 42R of the front side plate 40*a* and the respective left and right concentric circumferences parts 51L, 51R of the casing 50 is regulated to the thickness t of the intervening part 37. In addition, the drum unit 15 is supported at a total of three positions including an abutment position between the pressing member 45*a* of the drum unit biasing mechanism 45 and the lower face of the protrusion 55 of the casing 50 and another two abutment positions between the apexes of the left and right concentric circumferences parts 51L, 51R of the drum unit 15 and the lower faces 37*b* of the intervening parts 37 of the positioning member 30.

As has been described hereinabove, in the color printer 1 according to the embodiment, if the positioning member 30 is mounted to each elongated hole 43 formed above the opening 41 of the casing 40, only the sliding operation of the drum unit 15 through the opening 41 at corresponding attachment section makes it possible to position the drum unit 15 with respect to the printer main body 2 by the positioning member 30. Therefore, since the work of detaching or attaching the retainer as in the prior art is unrequired, the work of attaching or detaching the drum unit 15 can be made easy and a structure of the color printer 1 can be simplified. Also, since the opening 41 is formed in the front side plate 40*a* of the casing 40, the sliding operation of each drum unit 15 or the positioning operation with respect to the printer main body 2 by employing the positioning member 30 can be easily carried out. Further, since each drum unit 15 is positioned by employing the positioning member 30 having a same structure, the precision of the relative position of each drum unit 15 can be enhanced and therefore degradation in image quality, such as color displacement, at the time of forming a color image does not occur.

In detail, since the drum unit 15 is supported at a total of three positions including an abutment position between the pressing member 45*a* of the drum unit biasing mechanism 45 and the lower face of the protrusion 55 of the casing 50 and another two abutment positions between the apexes of the left and right concentric circumferences parts 51L, 51R of the drum unit 15 and the lower faces 37*b* of the intervening parts 37 of the positioning member 30, the drum unit 15 can be precisely positioned with respect to the printer main body 2.

Further, at the abutment position between the pressing member 45*a* of the drum unit pressing mechanism 45 and the lower face of the protrusion 55 of the casing 50, a part on the circumferential face of the roller-shaped pressing member 45*a* abuts against the flat lower face. In addition, at the another two abutment positions between the left and right concentric circumferences parts 51L, 51R of the casing 50 and the lower faces 37*b* of the intervening parts 37, a part on the circumferential face of each of the left and right circumferences parts 51L, 51R abuts against the flat lower face 37*b* of the intervening part 37. Thus, since each contact area of the three abutment positions is formed to be extremely small, the positioning precision by supporting at these three positions is improved more remarkably.

Furthermore, since the drum unit 15 is positioned by the left and right concentric circumferences parts 51L, 51R of the drum unit 15 that is concentric with the rotating shaft 9*a* of the photosensitive drum 9, the positioning precision of the photosensitive drum 9 can be enhanced in particular.

Still furthermore, since the intervening parts 37 of the positioning member 30 each have a high tolerance in the thickness direction, intervals between the left and right concentric circumferences parts 51L, 51R of the drum unit 15 and the respective left and right edges 42L, 42R of the front side plate 40*a* of the casing 40 can be managed with a high precision. Therefore, the drum unit 15 can be positioned with respect to the printer main body 2 with a high precision.

Still furthermore, since the positioning member 30 made of resin is provided so as to cover the notch 42 of the opening 41 of the casing 40, the casing 50 of the drum unit 15 less frequently comes into direct contact with the edge of the opening 41 of the casing 40 during the sliding operation of the drum unit 15 and, therefore, it becomes possible to reduce risk of damage on the drum unit 15.

In addition, since the supporting shaft 33 of the positioning member 30 can be varied in the diameter within a certain degree by elastically deforming inward in the diametrical direction, the position of the supporting shaft 33 can be adjusted for every printer 1.

Figure 10:
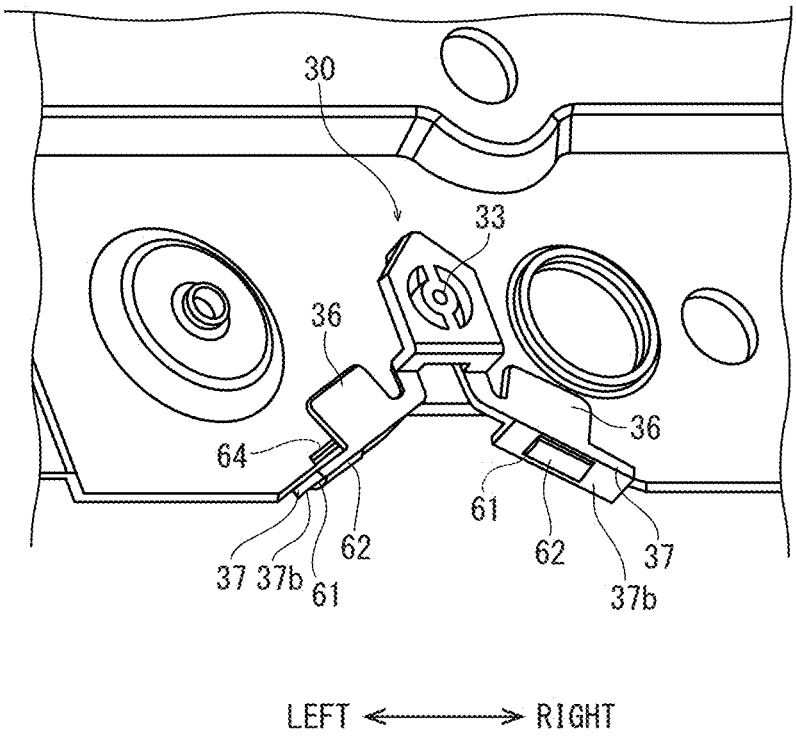
FIG. 10 is a perspective view showing another example of the positioning member, in the color printer according to the embodiment of the present invention.

Next, with reference to FIG. 10, another embodiment of the positioning member will be described. In this embodiment, at the center of each intervening part 37 of the positioning member 30, an aperture 61 extending in the left and right directions is formed. Between the left and right side faces of each aperture 61, a rotating shaft extending in parallel with each arm piece 32 is provided. Around the rotating shaft, a roller 62 is rotatably supported. The rollers 62 protrude upward and downward from the upper face 37*a* and the lower face 37*b* of the intermediate part 37, respectively.

Also, along each of the left and right edges 42L, 42R of the casing 40, a depression 64 in which the upper portion of the roller 62 is housed is formed at a position to corresponding roller 62 of the positioning member 30 attached to the casing 40. By forming the depression 64, the rollers 62 do not come into contact with the left and right edges 42L, 42R.

In this construction, when the drum unit 15 is biased upward by the drum unit biasing mechanism 45, the left and right concentric circumferences parts 51, 51R each abut against an outer circumferential face of the roller 62. Therefore, when the drum unit 15 is caused to slide along the rail 44 at the time of attaching or detaching the drum unit 15, since the casing 50 comes into contact with the rollers 62, the sliding property between the casing 50 and the positioning member 30 can be enhanced. Hence, the sliding operation of the drum unit 15 can be smoothly carried out.

The embodiment was described in a case of applying the configuration of the present disclosure to the printer 1. On the other hand, in another embodiment, the configuration of the disclosure may be applied to another image forming apparatus, such as a copying machine, a facsimile or a multifunction peripheral, except for the printer 1.

While the preferable embodiment and its modified example of the image forming apparatus of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

The invention claimed is:

1. An image forming apparatus comprising:

an image carrier unit configured to rotatably support an image carrier on which an electrostatic latent image is to be formed and attachable to or detachable from an apparatus main body; and a positioning member configured to position the image carrier unit with respect to the apparatus main body at an attachment position, wherein the image carrier unit has a concentric circumference part formed on a concentric circle with a rotating shaft of the image carrier, the apparatus main body has an edge part facing the concentric circumference part at the attachment position, the positioning member has an intervening part formed with an edge side abutment face facing the edge part of the apparatus main body and a unit side abutment face facing the concentric circumference part of the image carrier unit, and the image carrier unit is configured to be attachable to or detachable from the apparatus main body by sliding along an axial direction of the image carrier through an opening formed in the apparatus main body and to be attached to the apparatus main body by being biased upward at the attachment position, the edge part of the apparatus main body is formed at left and right portions along the upper edge of the opening so as to form a truncated reverse V-shape in a front view, wherein before the image carrier unit is biased upward at the attachment position, the intervening part of the positioning member faces the corresponding edge part of the apparatus main body at an interval, when the image carrier unit is biased upward at the attachment position, the unit side abutment face of the intervening part is pressed by the corresponding concentric circumference part of the image carrier unit and then the edge side abutment face of the intervening part abuts against the corresponding edge part of the apparatus main body, then the intervening part is intervened between the concentric circumference part of the image carrier unit and the edge part of the apparatus main body so that the image carrier unit is positioned with respect to the apparatus main body.

2. The image forming apparatus according to claim 1, wherein the image carrier unit is biased upward at the attachment position by a roller-shaped pressing member, and the image carrier unit is positioned with respect to the apparatus main body in the attachment position at three positions including an abutment position between the image carrier unit and the pressing member and at abutment positions between the concentric circumference parts and the respective intervening parts of the positioning member.

3. The image forming apparatus according to claim 1, wherein the apparatus main body is made of a metal plate, and the image carrier unit and the positioning member are made of resin.

4. The image forming apparatus according to claim 1, wherein the opening is formed in a front side plate of the apparatus main body.

5. The image forming apparatus according to claim 1 comprising a plurality of the image carrier units, wherein the positioning member is provided at the apparatus main body so as to correspond each of the image carrier units.

6. An image forming apparatus comprising:

an image carrier unit configured to rotatably support an image carrier on which an electrostatic latent image is to be formed and attachable to or detachable from an apparatus main body; and a positioning member configured to position the image carrier unit with respect to the apparatus main body at an attachment position, wherein the image carrier unit has a concentric circumference part formed on a concentric circle with a rotating shaft of the image carrier, the apparatus main body has an edge part facing the concentric circumference part at the attachment position, the positioning member has an intervening part formed with an edge side abutment face facing the edge part of the apparatus main body and a unit side abutment face facing the concentric circumference part of the image carrier unit, wherein the positioning member has:

a supporting part which is supported to the apparatus main body movably in a vertical direction and swingably in a horizontal direction; and a pair of arm pieces extending in a truncated reverse V-shape in a front view from a lower side of the supporting part, and the intervening part is provided at each of the pair of arm pieces such that the edge side abutment face and the unit side abutment face extend in parallel to the corresponding arm piece, wherein the intervening part is intervened between the concentric circumference part of the image carrier unit and the edge part of the apparatus main body so that the image carrier unit is positioned with respect to the apparatus main body.

7. The image forming apparatus according to claim 6, wherein an angle between the pair of arm pieces of the positioning member is equal to an angle between the edge parts of the apparatus main body.

8. The image forming apparatus according to claim 6, wherein the intervening part has:

a front tongue piece and a rear tongue piece respectively facing a front face and a rear face of the edge part of the apparatus main body; and a roller formed on the unit side abutment face and rotatable along with the sliding of the image carrier unit.

9. An image forming apparatus comprising:

an image carrier unit configured to rotatably support an image carrier on which an electrostatic latent image is to be formed and attachable to or detachable from an apparatus main body; and a positioning member configured to position the image carrier unit with respect to the apparatus main body at an attachment position, wherein the image carrier unit has a concentric circumference part formed on a concentric circle with a rotating shaft of the image carrier, the apparatus main body has an edge part facing the concentric circumference part at the attachment position, the positioning member has an intervening part formed with an edge side abutment face facing the edge part of the apparatus main body and a unit side abutment face facing the concentric circumference part of the image carrier unit, wherein the positioning member has:

a supporting part which is supported to the apparatus main body movably in a vertical direction and swingably in a horizontal direction; and a pair of arm pieces extending in a truncated reverse V-shape in a front view from a lower side of the supporting part, and the intervening part is provided at each of the pair of arm pieces such that the edge side abutment face and the unit side abutment face extend in parallel to the corresponding arm piece and has:

a front tongue piece and a rear tongue piece respectively facing a front face and a rear face of the edge part of the apparatus main body; and a roller formed on the unit side abutment face and rotatable along with the sliding of the image carrier unit, wherein the intervening part is intervened between the concentric circumference part of the image carrier unit and the edge part of the apparatus main body so that the image carrier unit is positioned with respect to the apparatus main body.

* * * * *